US005413617A

United States Patent [19]

Lin et al.

[11] Patent Number: 5,413,617

[45] Date of Patent: May 9, 1995

[54] PROCESS FOR THE PREPARATION OF SILVER POWDER WITH A CONTROLLED SURFACE AREA BY REDUCTION REACTION

[75] Inventors: Jing-Chie Lin; Jyuhn-Yih Wu; Sheng-Long Lee, all of Chung-Li, Taiwan, Prov. of China

[73] Assignee: National Science Council, Taipei, Taiwan, Prov. of China

[21] Appl. No.: 121,356

[22] Filed: Sep. 13, 1993

[51] Int. Cl.[6] ..... B22F 9/24

[52] U.S. Cl. ..... 75/371; 75/741

[58] Field of Search ..... 75/370, 371, 721, 741

[56] References Cited

U.S. PATENT DOCUMENTS

| | | | |
|---|---|---|---|
| 3,966,463 | 6/1976 | Fraioli et al. | 75/371 |
| 4,039,317 | 8/1977 | Montino et al. | 75/370 |
| 4,039,327 | 8/1977 | Dietz et al. | 75/721 |
| 4,456,473 | 6/1984 | Jost | 75/371 |
| 4,456,474 | 6/1984 | Jost | 75/741 |

FOREIGN PATENT DOCUMENTS

| | | | |
|---|---|---|---|
| 249808 | 9/1987 | German Dem. Rep. | 75/370 |
| 3827605 | 1/1990 | Germany | 75/721 |

*Primary Examiner*—George Wyszomierski
*Attorney, Agent, or Firm*—W. Wayne Liauh

[57] ABSTRACT

Silver powder with a controlled surface area is made by introducing a silver ion containing solution and a mixed solution containing reducing agents and surfactants into a low temperature tank of 5°–20° C. and holding for a period of 7–60 minutes, followed by introducing the resulting reaction solution into a high temperature tank and holding further. The rest potential of the reaction solution is monitored to determine the end point of the reaction.

7 Claims, 7 Drawing Sheets

PROCESS FOR THE PREPARATION OF SILVER POWDER WITH A CONTROLLED SURFACE AREA BY REDUCTION REACTION

BACKGROUND OF THE INVENTION

The present invention relates to a process for preparing silver powder with a controlled surface area by reduction reaction. More particularly, it relates to a continuous process for preparing silver powder by controlling the reaction time at low temperature and monitoring the rest potential of the reaction solution.

Growth in the electronics industry recently has led to an increased demand for precious metal powders. Silver powder, one of the precious metal powders, has become a very important conductive material in the electronics industry because of its superior conductivity, chemical stability and low price.

The main process for preparing silver powder is by chemical reduction. In carrying out the process, the starting silver nitrate is adjusted to alkaline with ammonium hydroxide, followed by adding a reducing agent, such as hydrazine, formaldehyde, acetaldehyde and reducing sugars to obtain silver precipitate. The reaction proceeds in accordance with the following equation:

silver ions+reducing agent→silver particles

The size of the particles thus produced is about 0.5 to 10 μm, and the density is 0.35 to 1.8 g/cm$^3$. However, the surface area(S.A.) of the produced particles merely ranges from 0.5 to 2 m$^2$/g. This is probably because the particles form cakes. The size, density and S.A. of the resulting silver powder are all suitable for use as electronic material. Thus, this technique has become the main process for preparing silver powder in the electronics industry. (Montino et al., U.S. Pat. No. 4,039,317 and Fraioli et al., U.S. Pat. No. 3,966,463)

Taiwan Patent No. 43,382 discloses an improved process for preparing silver powder. The procedures for this process are shown in FIG. 1. This process is characterized in that the reducing agent is first mixed with surfactants during reducing process prior to reacting with a silver ammoniacal solution. By this process, the amount of wastewater is reduced, and the yield of silver powder is increased.

Jost et al. in their U.S. Pat. Nos. 4,456,473 and 44,456,474 have disclosed that by mixing ammonium hydroxide with silver nitrate, then with hydrazine, or mixing ammonium hydroxide with hydrazine, then with silver nitrate, silver powder with a particle size of 3 to 5 μm(the former) or 0.6 to 2.5 μm(the latter) can be obtained as long as the molar ratio is appropriate. However, according to the examples set forth in the two patents, the reaction solution must be sprayed through a nozzle at a high pressure of 5000 psi. This adds to the difficulty of installing the manufacturing equipment and also increases the danger of operating it. Furthermore, the surface area of the silver powder produced by this method is insufficent.

Silver powder for making thick films of conductors must have suitable properties for being mixed with solvents and glass powders, etc. to obtain silver pastes. The properties of silver powder are determined by its surface area, particle size, particle size distribution, tap density and manner of surface treatment. However, as prior methods for producing silver powder all involve batch type chemical reduction processes, the properties of silver powder can only be controlled by varying the concentrations of reactants, the stirring speed of the reactors containing the reactants, and the reaction temperature based on experiential data. Therefore, silver powder with a controlled surface area is often unobtainable. The qualities of electronic products using the silver powders are thus tremendously affected.

To obtain silver powder having a controlled surface area by batch type chemical reduction processes, the concentrations of the reactants must be adjusted precisely, or the produced silver powders must be subjected to post mechanical grinding treatment. According to the methods of U.S. Pat. No. 4,456,473 and U.S. Pat. No. 4,456,474, properties of silver powder produced by reacting hydrazine, ammonium hydroxide and silver nitrate are controlled by changing their concentrations. In the examples, the particle size of the produced powders were respectively controlled to within the range of 3 to 5 μm and 0.6 to 2.5 μm, and the surface areas were controlled to about 2 m$^2$/g. However, as the silver powder was produced by batch type reaction, the surface area of silver powder produced by each batch can not be controlled to within a desired range. That is to say, silver powders produced by each batch will have different surface area. Subjecting the produced silver powder to post-grinding treatment can produce silver powder with suitable surface area, however, post-grinding will cause the resultant silver powder to become flake shaped because of its high ductility. This morphology change will restrict its usefulness in the electronics industry.

SUMMARY OF THE INVENTION

An object of the present invention is therefore to provide an improved process for preparing silver powder with a controlled surface area.

To attain the above object, the process of the present invention includes (a) providing a 1.5–6 volume % silver ion solution; (b) providing a mixed solution containing 1 to 10 volume % reducing agents and 3 to 8 volume % surfactants; (c) introducing the silver ion solution and the mixed solution at a flow rate of 60 to 200 ml/min into a low temperature reaction tank of 5° to 20° C. and stirring to obtain a reaction solution, and holding the reaction solution in the tank for 7–60 minutes; (d) introducing the reaction solution into a high temperature tank of 40° to 60° C., and monitoring the rest potential of the reaction solution; and (e) separating precipitated silver powder from the reaction solution after no substantial change of the rest potential is observed.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

It has been found that during the reaction of a silver ion containing solution with a reducing agent, the rest potential of the reaction solution changes with the reaction time in a specific manner, and the formation of silver powders includes the steps of forming precursors of silver powder, called "embryos", growing larger to silver nuclei, and then growing into silver powders.

Figure 2:
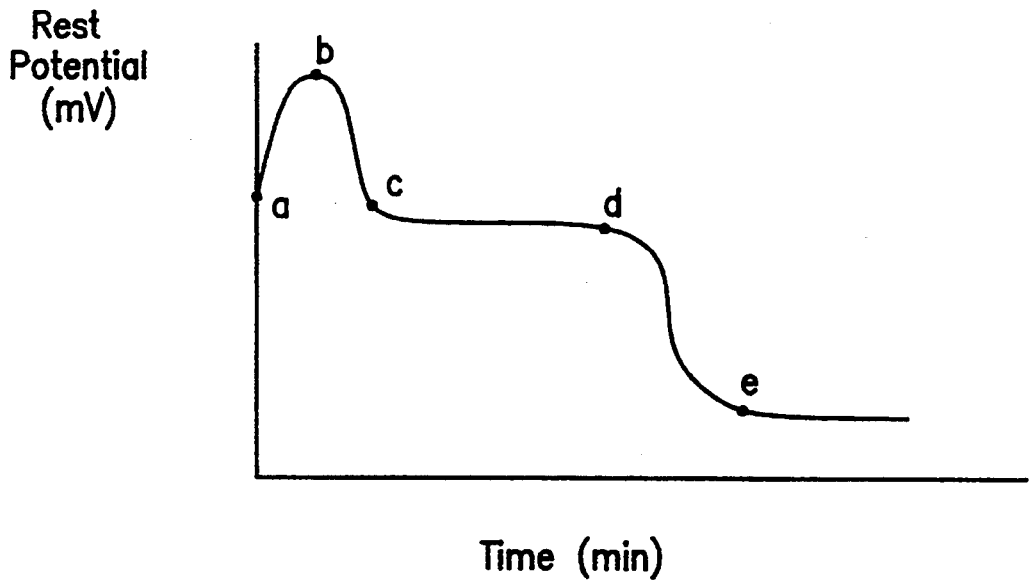
FIG. 2 is a diagram showing a plot of the rest potential of the silver ion containing solution versus reaction time according to the present invention.

Referring now to FIG. 2, which is a diagram showing the plot of rest potential of the reaction solution versus the reaction time. Curve a→b is the stage where the reducing agent breaks the energy barrier of the polar molecules around silver ions. In this stage, the rest potential is initially in a relatively high level, because no silver embryo has formed. Gradaully with the release of embryos, the rising speed of potential starts to decrease and the potential reaches to a maximum at point b. Since the embryos formed at stage a→b are not stable and are apt to disappear or grow larger, the number of embryos at stage a→b is not large, therefore the color of the solution in this stage is pale yellow. In stage b→c, a large number of stable nuclei gradually form from embryos and results in the color changes of the solution from pale yellow to orange, red and finally violet red, and the drop of rest potential. In stage c→d, the rest potential remains flat indicating no violent oxidation-reduction reaction has occurred, only slight changes such as the completeness of the formation of nuclei, resulting in the color change from violet red to black. Stage d→e is the stage where the nuclei grow larger and the reaction is complete. At this stage, it is observed that silver powder gradually appears, floating over the surface of solution or sinking to the bottom, until the rest potential becomes horizontal.

In view of the above observations, it is presumed that point d in the rest potential curve is the boundary point between formation and growth of the nucleus. Therefore, if the formation stage(a→b→c→d) and growth stage(d→e) are set appropriately by controlling experimental parameters, silver powder with different physical properties can be obtained.

It has also been found that an elevated reaction temperature benefits the formation and growth of nuclei. That is to say, embryos formed at an elevated temperature will grow rapidly to exceed the critical radius(r*) and form stable nuclei. The greater the number of stable nuclei, the finer the obtained silver powders are, and the higher the yield. Therefore, if the reduction reaction is conducted at an elevated temperature, the rest potential of the solution changes more quickly and the obtained silver powders have a higher S.A. On the other hand, it is not easy to form stable nuclei and grow them, hence only a small number of the formed nuclei have the chance to grow when the reaction is conducted at a relatively low temperature. If the reaction temperature is raised at a later time, the silver ions in the solution will be reduced to a small number of nuclei, which makes the nuclei grow and, as a result, the S.A of the produced silver powder per unit mass is small and the grain of the silver crystal is large. The longer the holding time in the low temperature is, the more evident the above phenomenon is.

Therefore, according to the above findings, silver powders with a controlled surface area can be obtained if the holding time of reaction at low temperature can be properly adjusted and the whole reaction is monitored by measuring the rest potential of the reaction solution.

According to the present invention, a silver ion containing solution and a mixed solution of reducing agents and surfactants are introduced into a low temperature reaction tank of 5°–20° C., stirred to obtain a reaction solution, which be held in the tank for a period of 7–60 minutes, followed by introduction into a high temperature reaction tank of 40°–60° C. and stirred for a period of time to obtain the precipitated silver powder. The silver ions containing solution and the mixed solution should be introduced into the low temperature reaction tank at a constant flow rate, for example, 60–200ml/min, and then introduced into a high temperature reaction tank of 40°–60° C. at the same flow rate so that the whole process is a continuous process. The whole process of the present invention is monitored by the rest potential of the reaction solution. When the rest potential is observed to be becoming horizontal, the reaction is deemed as complete, as discussed above, and the silver powder is recovered by filtration or other means.

The silver ion solution according to the present invention should contain 1.5–6 volume percent silver ion. An example of preparing the silver ion solution is first dissolving silver pellets in nitric acid, diluting the solution and then adding ammonia water to obtain an ammoniacal silver solution.

According to the present invention, the mixed solution should contain 1–10 volume percent reducing agents and 3–8 volume percent of surfactants. The reducing agents suitable for use in the present invention are hydrazine, formaldehyde, acetaldehyde and reducing sugars. Surfactants suitable for use in this invention include caproic acid, caprylic acid, triethanolamine, glycerin and oleic acid.

PREFERRED EMBODIMENT OF THE PROCESS OF THE INVENTION

Figure 3:
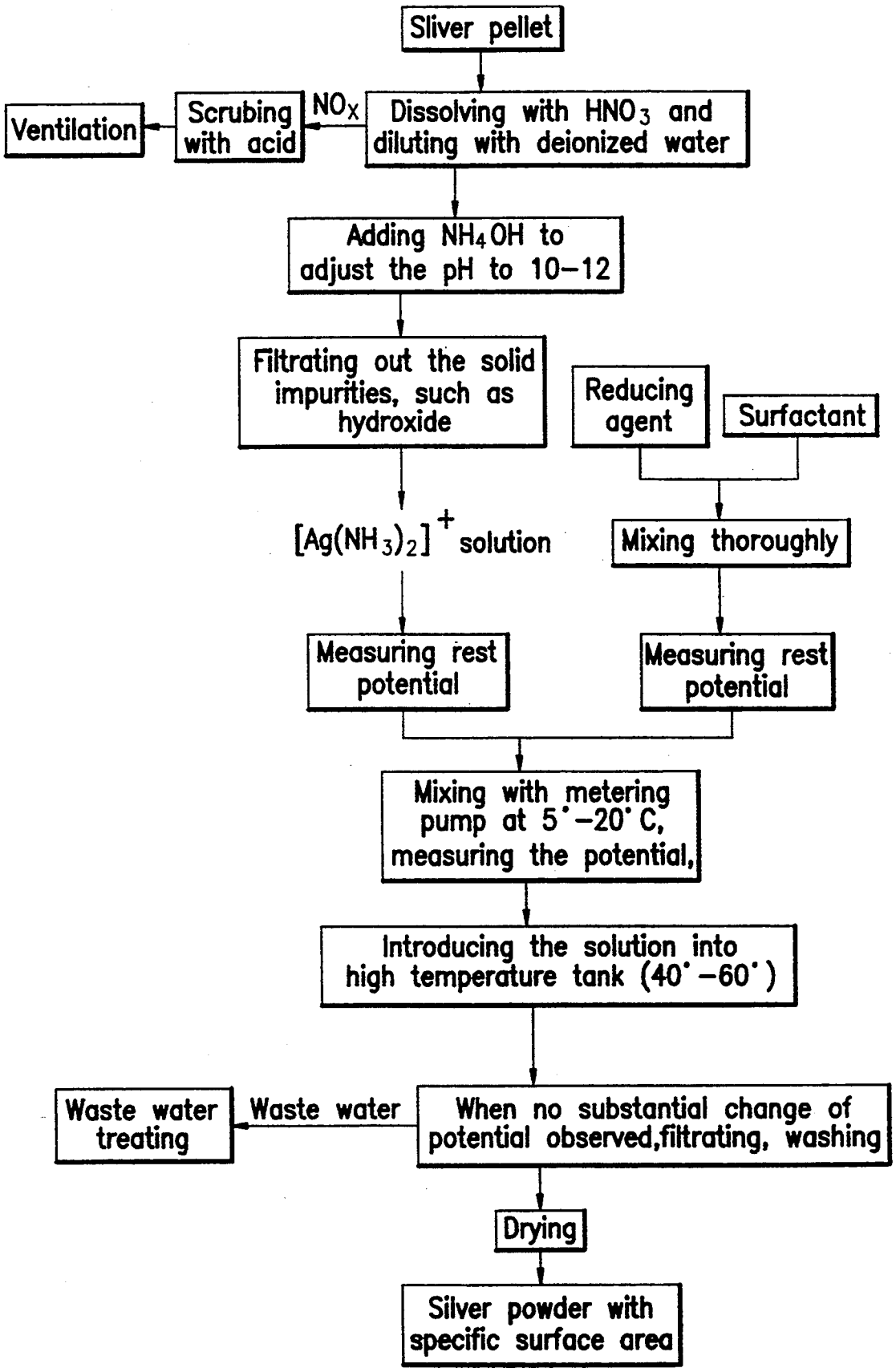
FIG. 3 is a flow chart of the process of a preferred embodiment of the present invention.

Referring to FIG. 3, an ammoniaical silver solution is prepared by dissolving silver pellets in nitric acid, diluting the solution, adding ammonia water to the resultant solution to adjust the pH value to 10–12, and filtering out the solid impurities. A mixed solution is prepared by mixing a reducing agent solution and a surfactant solution. Before the ammoniaical silver solution and mixed solution are introduced to the low temperature tank for reaction, their rest potentials are measured respectively. The potentials are expressed with respect to saturated calomel electrode(SCE). Note that the ammoniaical silver solution and the mixed solution are introduced at a constant flow rate, and are held in the tank for a time period of 7–60 minutes with stirring, the low temperature reaction tank is maintained at a temperature of 5°–20° C., and the rest potential of the reaction solution is measured to monitor the reaction. The reaction solution in the low temperature tank is thereafter introduced to the high temperature tank, which is maintained at a temperature of 40°–60° C., and is held therein for a time period, for example 30–60 minutes. The potential of the reaction solution in the high temperature tank is also measured constantly and when no substantial change of the potential is observed, the reaction solution is drained out from the high temperature tank, filtered, washed with water and dried at 95° C. to obtain the silver powder.

The following specific examples are intended to demonstrate this invention more fully without acting as a limitation upon its scope.

EXAMPLE 1

A 500 ml solution of 3% ammoniacal silver and a solution containing 25 ml of hydazine, 30 ml of triethanolamine, 30 ml of caprylic acid in 500 ml of water were separately prepared, poured into two Erlenmeyer flasks, and kept at a temperature of 20° C.

The two solutions were then introduced into a low temprerature tank, which was maintained at a temperature of 20° C., by a metering pump at a flow rate of 200 ml/min, and mixed thoroughly by a mechanical stirrer rotated at 200 rpm for 7 minutes. The rest potential of the solution in the low temperature tank was measured constantly.

The resulting solution was then introduced into a high temperature tank, which was maintained at a temperature of 50° C., and held until no substantial change of the measured rest potential was observed. After filtration, washing and drying, silver powder was obtained. The rest potential at point d, the tap density, and surface area of the obtained silver powder were measured. The results are shown in Table 1.

EXAMPLE 2

The same procedure as described in Example 1 was employed, except that the reaction solution was held in the low temperature tank for 14 minutes. The rest potential at point d, tap density and surface area of the obtained silver powder are also shown in Table 1.

EXAMPLE3

The same procedure as described in Example 1 was employed, except that the reaction solution was held in the low temperature tank for 10 minutes. The rest potential at point d, tap density and surface area of the obtained silver powder are also shown in Table 1.

EXAMPLE 4

The same procedure as described in Example 1 was employed, except that the reaction solution was held in the low temperature tank for 20 minutes. The rest potential at point d, tap density and surface area of the obtained silver powder are also shown in Table 1.

EXAMPLE 5

The same procedure as described in Example 1 was employed, except that the reaction solution was held in the low temperature tank for 30 minutes. The rest potential at point d, tap density and surface area of the obtained silver powder are also shown in Table 1.

TABLE 1

| Examples | $Ag^+$ % | H | T % | C | stirring speed rpm | flow rate ml/min | Tem. °C.→min | potential at point d($mV_{SCE}$) | T.D. $g/cm^3$ | S.A. $m^2/g$ |
|---|---|---|---|---|---|---|---|---|---|---|
| 1 | 3 | 5 | 6 | 6 | 200 | 200 | 20→7<br>50→ | −15 | 2.62 | 7.91 |
| 2 | 3 | 5 | 6 | 6 | 200 | 200 | 20→14<br>50→ | −44 | 2.74 | 6.30 |
| 3 | 3 | 5 | 6 | 6 | 200 | 200 | 20→10<br>50→10 | −21 | 2.80 | 7.25 |
| 4 | 3 | 5 | 6 | 6 | 200 | 200 | 20→20<br>50→ | −63 | 2.58 | 5.23 |
| 5 | 3 | 5 | 6 | 6 | 200 | 200 | 20→30<br>50→ | −88 | 2.64 | 2.86 |

H = Hydrazine
T = Triethanolamine
C = caprylic acid

Figure 4:
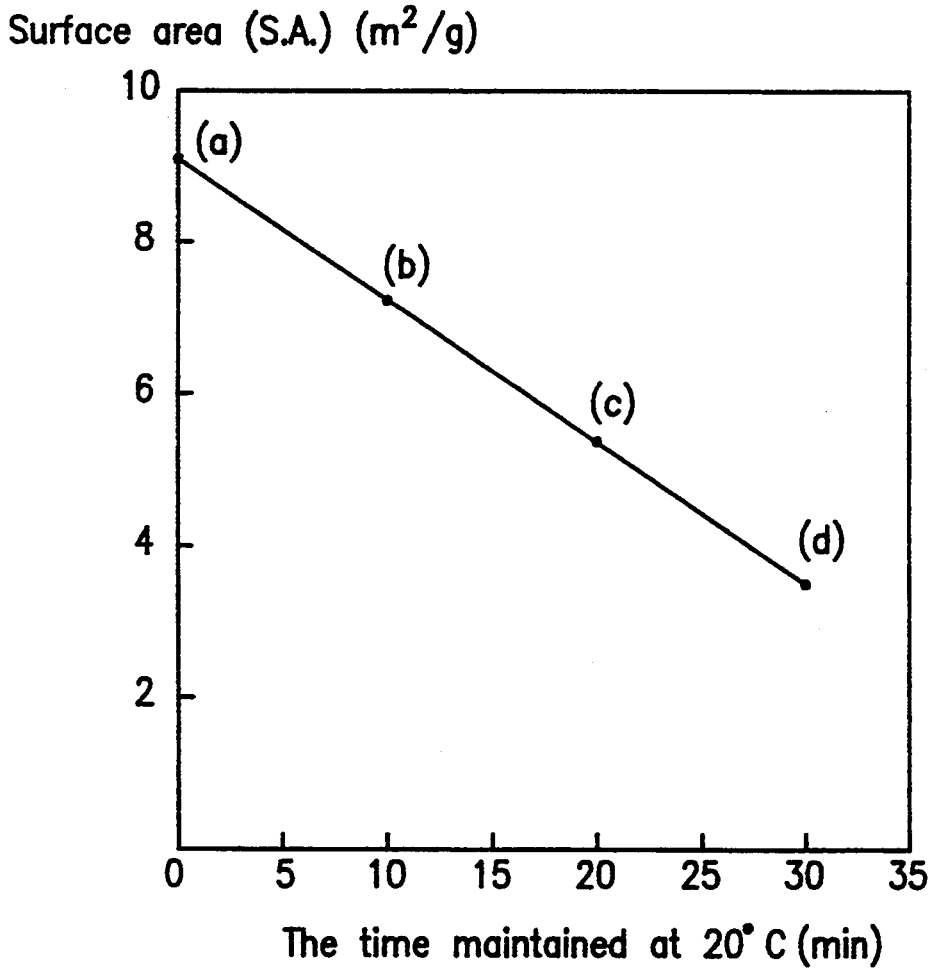
FIG. 4 shows the linear relationship between the S.A. of the silver powder and the holding time of the reaction solution in a low temperature tank.

From the above Table 1, it is seen that the longer the holding time in the low temperature tank is, the smaller the surface area of the obtained silver powder will be. This conclusion can also be seen from FIG. 4. Point(b) is plotted according to Example 3 wherein the time maintained at 20° C. is 10 minutes, point(c) is plotted according to Example 4 wherein the time maintained at 20° C. is 20 minutes, and point(d) is plotted according to Example 5 wherein the time maintained at 20° C. is 30 minutes. The surface area of the silver powder and the time maintained at 20° C. shows a linear relationship.

COMPARATIVE EXAMPLE 1

Figure 1:
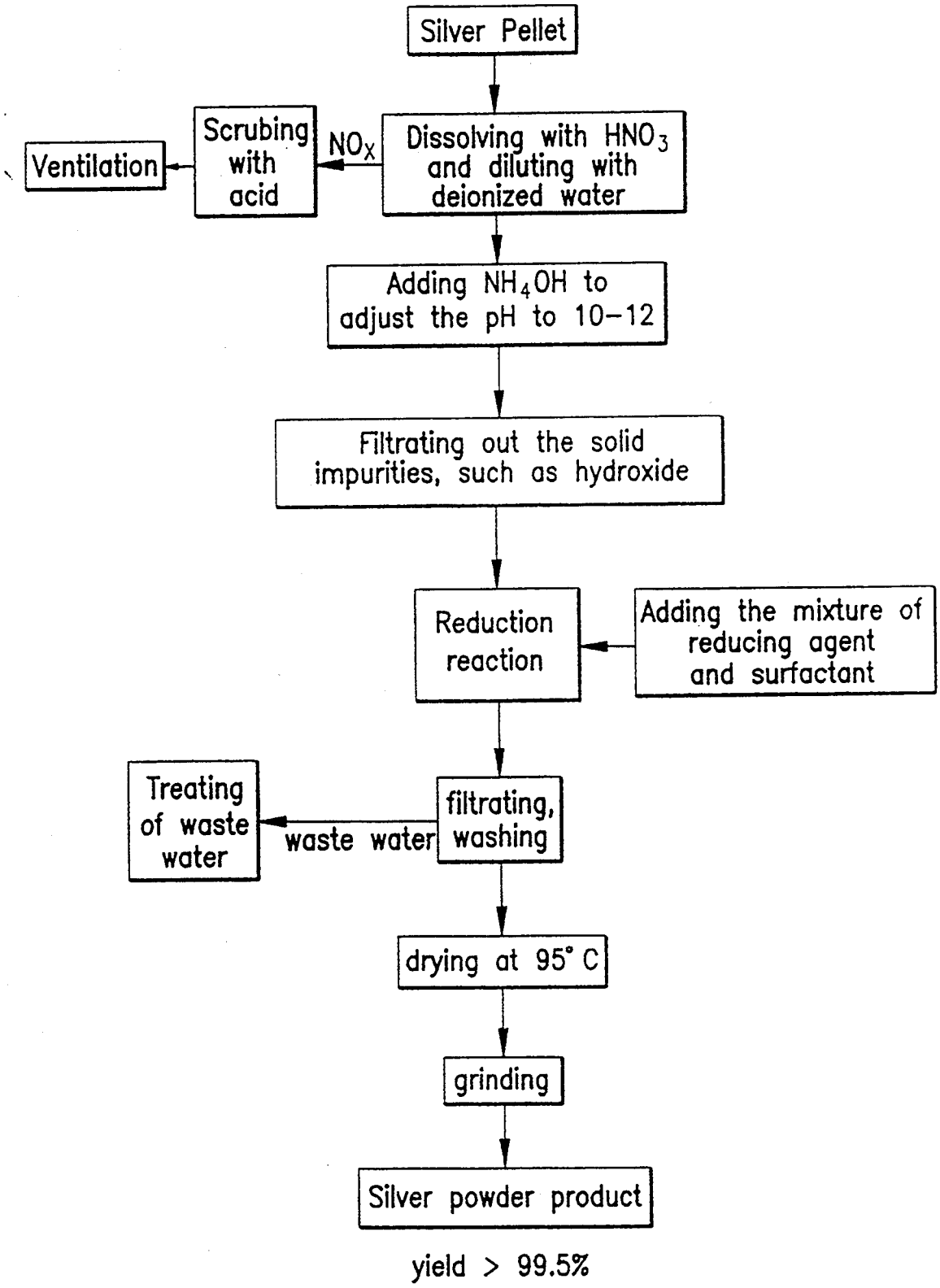
FIG. 1 (Prior Art)
FIG. 1 is a flow chart showing the process of R.O.C. Invention Pat. No. 43382.

Silver powder was prepared by using the procedures as depicted in the flow chart of FIG. 1. That is, ammoniacal silver solution and mixed solution were directly introduced into a tank of 50° C. for reaction. The resulting silver powder has a surface area of 3.9 $m^2/g$.

Figure 5A:
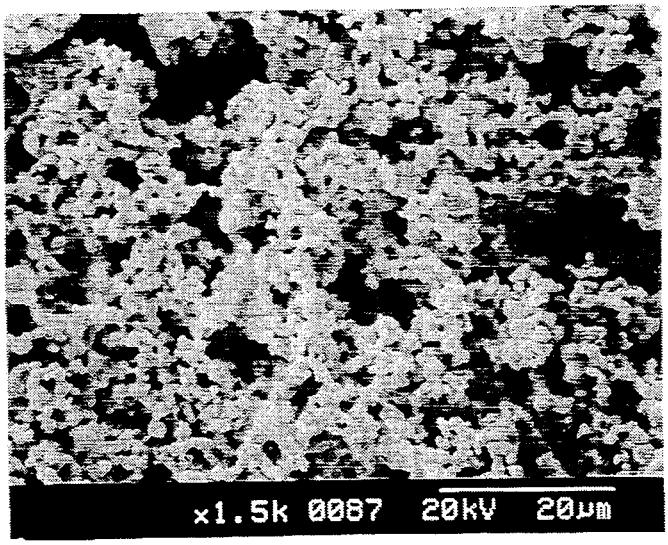
FIG. 5*a* is a SEM picture at 1200 magnification of the thick film sintered at 450° C. in which the silver powder is prepared from comparative Example 1.
Figure 5B:
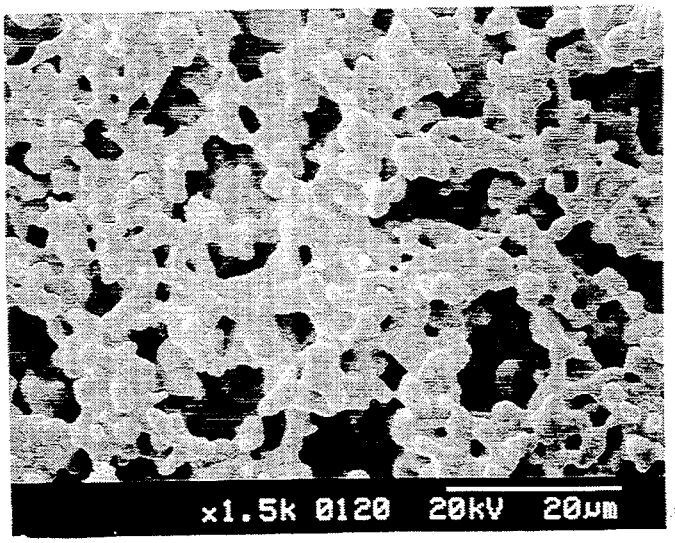
FIG. 5*b* is a SEM picture at 1200 magnification of the thick film sintered at 600° C. in which the silver powder is prepared from comparative Example 1.
Figure 5C:
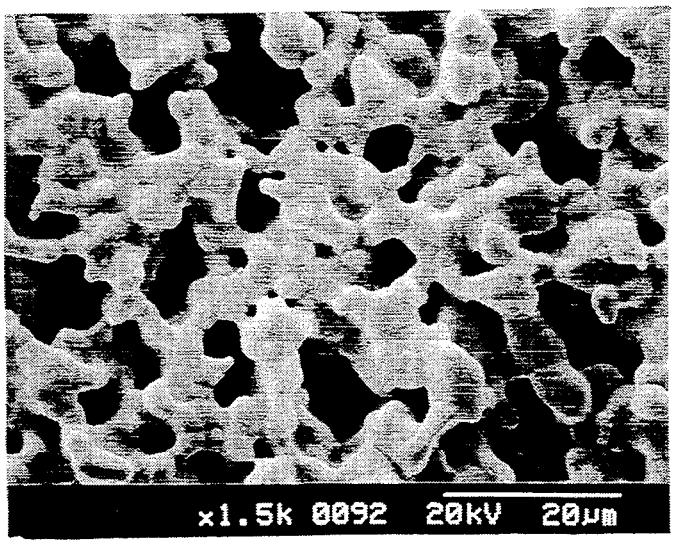
FIG. 5*c* is a SEM picture at 1200 magnification of the thick film sintered at 750° C. in which the silver powder is prepared from comparative Example 1.
Figure 5D:
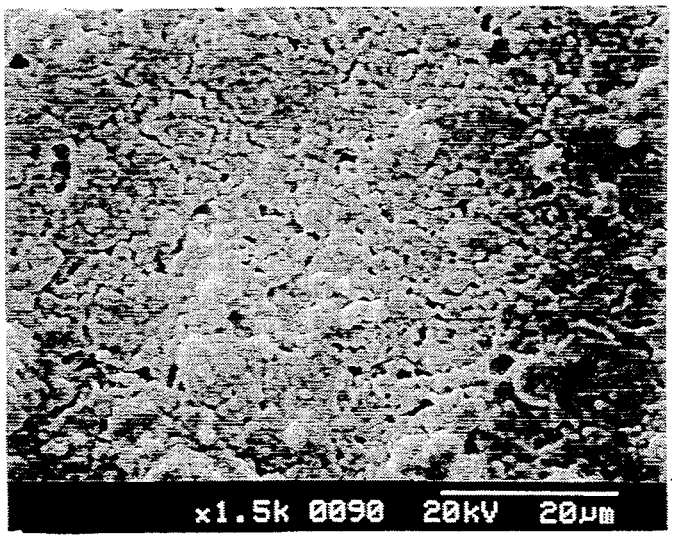
FIG. 5*d* is a SEM picture at 1200 magnification of the thick film sintered at 450° C. in which the silver powder is prepared from Example 3.
Figure 5E:
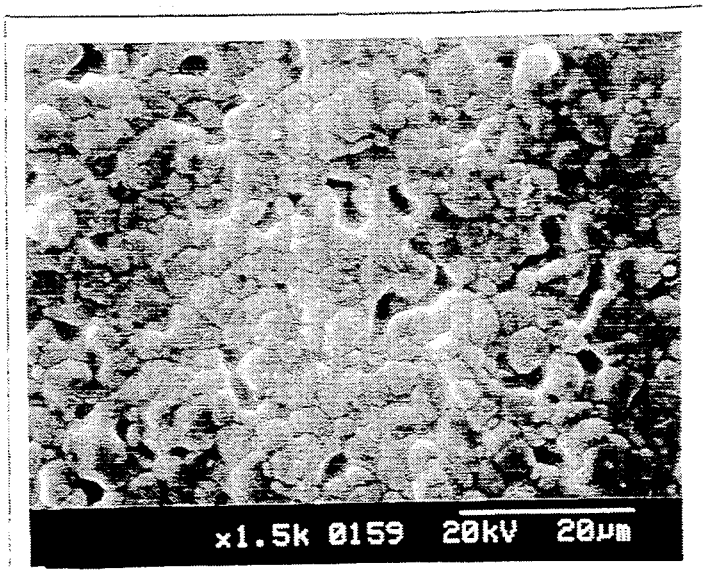
FIG. 5*e* is a SEM picture at 1200 magnification of the thick film sintered at 600° C. in which the silver powder is prepared from Example 3.
Figure 5F:
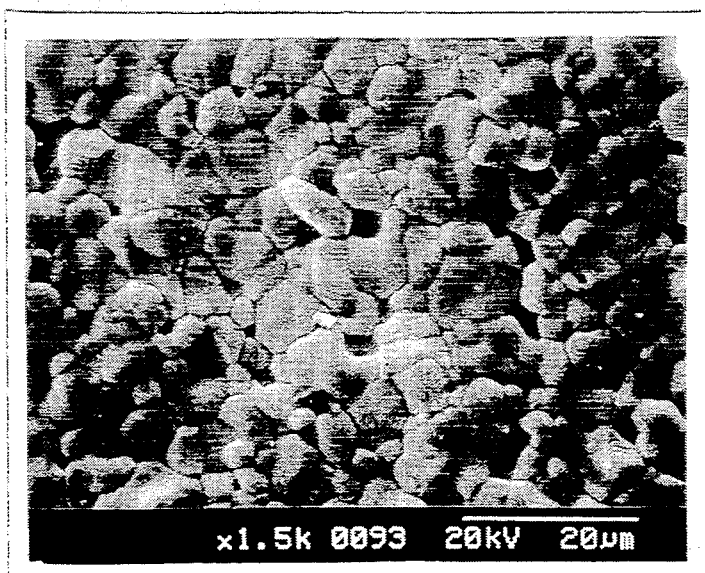
FIG. 5*f* is a SEM picture at 1200 magnification of the thick film sintered at 750° C. in which the silver powder is prepared from Example 3.

The silver powders prepared in Example 3, which have a surface area of 7.25 $m^2/g$, and the silver powders prepared in comparative Example 1, which has a surface area of 3.9 $m^2/g$ were formed into silver paste and fabricated into thick films. These thick films were sintered at 450° C., 600° C. and 750° C. respectively, and then observed under SEM. The SEM pictures are shown in FIGS. 5*a* to FIG. 5*f*, wherein FIG. 5*a* is a SEM picture of thick film prepared from silver powders of comparative Example 1 and sintered at 450° C., FIG. 5*b* is a SEM picture of thick film prepared from silver powders of comparative Example 1 and sintered at 600° C., FIG. 5*c* is a SEM picture of thick film prepared from silver powders of comparative Example 1 and sintered at 750° C., FIG. 5*d* is a SEM picture of thick film prepared from silver powders of Example 3 and sintered at 450° C., FIG. 5*e* is a SEM picture of thick film prepared from silver powders of Example 3 and sintered at 600° C., and FIG. 5*f* is a SEM picture of thick film prepared from silver powders of Example 3 and sintered at 750° C. As shown in FIG. 5*a* and FIG. 5*b*, the particles are not fine enough and have many voids. The particles shrink and enlarge the voids when they are sintered at a higher temperature, as shown in FIG. 5*c*. These thick films will have bad conductivity. On the other hand, the silver particles prepared from this invention are closely packed at low sintering temperature, and remain dense even when sintered at higher temperature, as can been seen in FIGS. 5*d*–5*f*. Therefore, the thick films prepared by the silver powders of the present invention have superior conductivity.

According to the present invention, the surface area of the produced silver powder can be easily adjusted by changing the holding time of the reaction solution in the low temperature tank and the finish of the reaction can be easily determined by observing the measured rest potential.

What is claimed is:

1. A process for preparing silver powder with a controlled surface area, comprising the following steps:

(a) providing a 1.5–6 volume % silver ion solution;

(b) providing a mixed solution containing 1 to 10 volume % reducing agents and 3 to 8 volume % surfactants;

(c) introducing the silver ion solution and the mixed solution at a flow rate of 60 to 200 ml/min into a low temperature reaction tank of 5° to 20° C. and stirring to obtain a reaction solution, and holding the reaction solution for 7–60 minutes, and monitoring the rest potential of the reaction solution;

(d) introducing the reaction solution into a high temperature tank of 40° to 60° C.; and (e) separating precipitated silver powder from the reaction solution after a period during which substantially no change in rest potential is observed.

2. The process as claimed in claim 1, wherein the reducing agent is selected from the group consisting of hydrazine, formaldehyde, acetaldehyde and reducing sugars.

3. The process as claimed in claim 1, wherein the surfactant is selected from the group consisting of caproic acid, caprylic acid, triethanolamine, glycerin and oleic acid.

4. The process as claimed in claim 1, wherein the silver ion solution is a 3 volume % ammoniacal silver solution.

5. The process as claimed in claim 1, wherein the mixed solution contains 5 volume % hydrazine as a reducing agent.

6. The process as claimed in claim 1, wherein in step (c), the temperature of the low temperature tank is maintained at 20° C. and the stirring time is 7 minutes.

7. The process as claimed in claim 1, wherein in step (e), the silver powder is obtained by separating precipitated silver powder from the reaction solution by filtration, washing said silver powder and drying the powder.

* * * * *